United States Patent [19]

Ortiz

[11] 4,091,577

[45] May 30, 1978

[54] WET-SANDING MACHINE

[76] Inventor: Antonio Ortiz, 420-18 E. 111th St., New York, N.Y. 10029

[21] Appl. No.: 738,119

[22] Filed: Nov. 2, 1976

[51] Int. Cl.[2] ..... B24B 55/02

[52] U.S. Cl. ..... 51/170 T; 51/267

[58] Field of Search ..... 51/170 T, 170 PT, 170 R, 51/356, 266, 367, 267

[56] References Cited

U.S. PATENT DOCUMENTS

| | | | |
|---|---|---|---|
| 3,110,993 | 11/1963 | Grage | 51/267 |
| 3,987,589 | 10/1976 | Marton | 51/170 T |

FOREIGN PATENT DOCUMENTS

| | | | |
|---|---|---|---|
| 851,617 | 10/1952 | Germany | 51/267 |
| 2,359,715 | 6/1975 | Germany | 51/356 |

*Primary Examiner*—Harold D. Whitehead
*Assistant Examiner*—Roscoe V. Parker
*Attorney, Agent, or Firm*—Karl F. Ross

[57] ABSTRACT

A hand-held power-operable wet-sanding machine includes a frame and a rotatable spindle carried thereby. A sanding wheel is detachably mounted on the spindle. A motor is provided for rotating the spindle. An annular liquid reservoir is mounted removably on the sanding wheel and concentrically surrounds it. The bottom wall of the reservoir is provided with discharge apertures. In a preferred form the spindle is driven by an air motor and a conduit conducts pressurized air to the reservoir to maintain a predetermined pressure on the liquid within the reservoir.

6 Claims, 3 Drawing Figures

WET-SANDING MACHINE

FIELD OF THE INVENTION

My present invention relates to hand-held power-operable tools and, more particularly, to a wet-sanding machine of this character.

BACKGROUND OF THE INVENTION

In the finishing of the bodies of vehicles it generally is required to sand the putty or filler used prior to painting. Dry sanding often leaves scratches and other aberrations which are not always completely hidden by the coats of paint. In addition, considerable dust is discharged into the atmosphere of the repair shop, creating health hazards for the workmen. Accordingly, it has been proposed (see, for example, U.S. Pat. No. 3,395,495) to resort to wet sanding in order to finish the surfaces of the vehicle body in preparation for painting. In some systems a spray bar directs the stream of liquid across the top of the abrasive wheel, thereby resulting in the loss of liquid prior to the time it reaches the surface being sanded and also introducing a quantity of liquid into the machine itself, thus requiring a special water-tight construction for certain of the machine elements which might otherwise be damaged through exposure to the liquid. Further, since there is a substantial distance between the spray bar and the surface to be sprayed, excess quantities of liquid may be required in order to insure the provision of the desired amount of liquid on the work surface of the vehicle.

OBJECTS OF THE INVENTION

It is an object of my present invention to provide a hand-held power-operable sanding machine which is adapted to provide desired quantities of a liquid at a work surface to be sanded without loss of any part of that liquid en route to that surface.

It is another object of this invention to provide a wet-sanding machine of the character described in which the liquid is stored and discharged without risk of spillage into the working components of the machine.

SUMMARY OF THE INVENTION

I realize these objects, in accordance with my present invention, by concentrically disposing an apertured brush carrier about a sanding wheel which is carried on a shaft journaled in a frame for rotation about its axis, together with conduit means extending from a source of water toward the apertured brush carrier for wetting its bristles. The brush carrier and the sanding wheel are provided with drive means for rotating them about their common axis, the bristles terminating substantially flush with an abrasive underside of the sanding wheel so as to scour a work surface being sanded.

Advantageously, pursuant to a more particular feature of my invention, the brush carrier is a bottom part of an annular liquid reservoir communicating with the aforementioned conduit means. I prefer to close the top of that reservoir and to connect it, via a tube, to a supply of compressed air which may also serve to power the drive motor of the sanding wheel. The air pressure thus built up inside the reservoir helps expel the water through its bottom apertures, at a rate which may be controlled by a pressure-regulating valve.

Pursuant to a further feature of my invention, the liquid reservoir with its bristles is secured to the sanding wheel for joint rotation therewith. In that instance, however, the presence of the water and air connections attached to the reservoir limits such rotation to an oscillatory motion.

BRIEF DESCRIPTION OF THE DRAWING

In order that the invention may be more fully comprehended it will now be described, by way of example, with reference to the accompanying drawing in which.

DETAILED DESCRIPTION OF THE INVENTION

Figure 1:
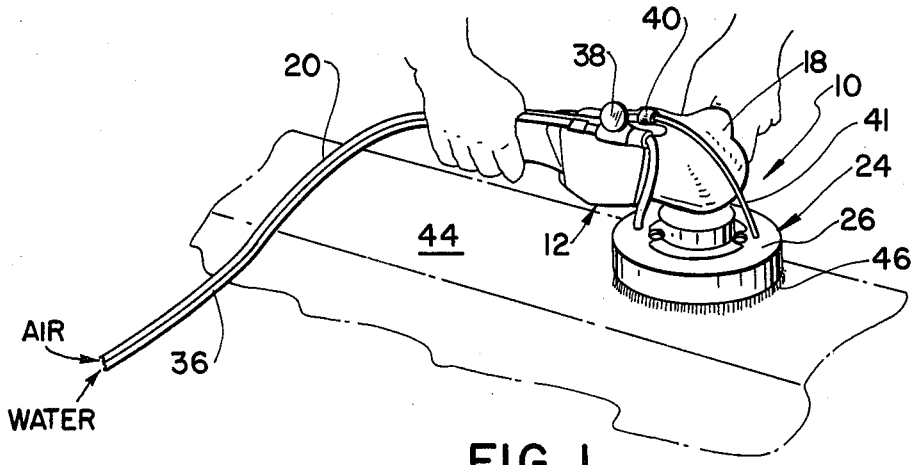
FIG. 1 is a perspective view of a wet-sanding machine according to my invention, shown in relation to a surface being sanded.

A hand-held power-operable wet-sanding machine according to my invention, generally designated 10, includes a frame 12 which carries a rotatable spindle 14 detachably supporting a sanding wheel 16. The spindle is carried by the frame in a conventional manner and is powered by a motor 18 which may be operable either electrically or by pressurized air. In the latter instance, as shown in FIG. 1, a hose 20 is connected at one end to an air supply, symbolized by an arrow, and at the other end to the air motor 18.

A sanding element 22 such as an abrasive disk of sandpaper or emory cloth is carried at the lower end of the sanding wheel 16 and may be secured thereto by any conventional fastening means (not shown). The structure described heretofore is conventional and, therefore, the present specification is not being encumbered with the constructional details thereof.

An annular liquid reservoir 24 is mounted on the sanding wheel and concentrically surrounds same. The reservoir includes a top wall 26 which has a pair of radially inwardly directed flanges 28 integral therewith. These flanges are disposed at diametrically opposed locations and are each provided with an aperture 30 dimensioned to receive conventional fastening means 32, such as a screw, in order to secure the reservoir to the sanding wheel. The reservoir also includes a bottom wall 34 in which a plurality of discharge apertures 35 are formed.

Figure 2:
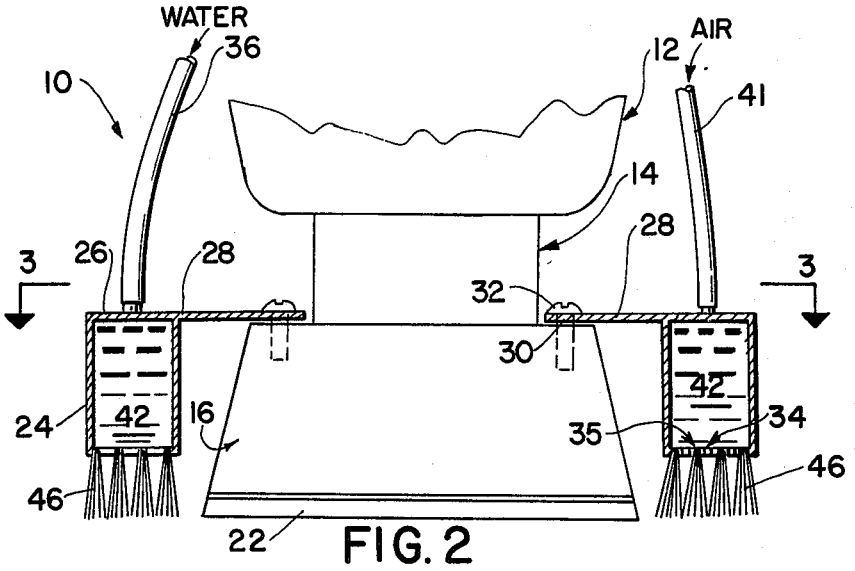
FIG. 2 is a fragmentary schematic cross-sectional view of the machine shown in FIG. 1, drawn to a larger scale.
Figure 3:
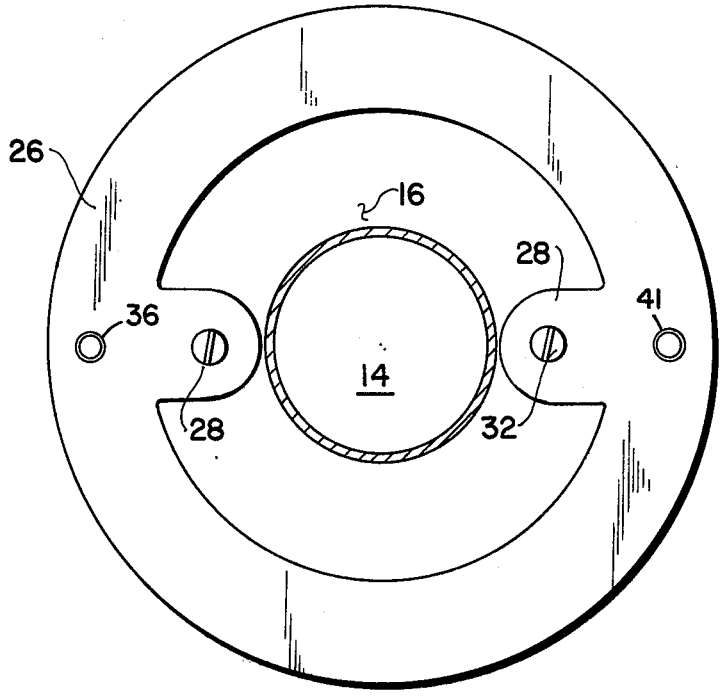
FIG. 3 is a cross-sectional view taken along line 3—3 of FIG. 2.

A conduit 36 is provided for the introduction of a liquid, preferably water, into the reservoir from a source symbolized by an arrow. A valve 38 is connected to conduit 36 for the purpose of regulating the flow of water to the reservoir. As shown most clearly in FIG. 2 the conduit 36 terminates in the top wall of the reservoir to introduce the liquid 42 into same.

The air hose 20 has an extension 41 provided with a control valve 40 in order to maintain a predetermined pressure upon the liquid 42 contained in the reservoir. This hose extension 41 is connected to top wall 26 at a location diametrically opposite its junction with conduit 36. Thus, the liquid within the reservoir is under the pressure developed at its source of supply and the air pressure conducted via hose extension 41. The water is, therefore, positively discharged under the joint control of valves 38 and 40 from the bottom apertures 35 of the reservoir directly upon the work surface 44 to be sanded.

A brush element comprising an annular array of bristle tufts 46 is secured to the bottom wall of the reservoir, the bristles ending substantially flush with sanding disk 22 for contact with the work surface. The discharge apertures 35 are interspersed with the bristles 46. It will, of course, be understood that the motor 18 can impart only a reciprocatory or oscillatory motion to the sanding wheel 16 and the reservoirs 24, the stroke of that oscillation being obviously limited by the deformability of tubes 36 and 41.

I claim:

1. A hand-held power-operable wet-sanding machine comprising:

a frame;

a generally vertical spindle journaled in said frame;

a sanding wheel with an abrasive underside mounted on said spindle for rotation about its axis;

an apertured brush carrier concentrically disposed about said sanding wheel and provided with bristles terminating substantially at the level of said abrasive underside;

drive means for rotating said sanding wheel and said brush carrier about said axis; and conduit means connected to a source of water and extending toward the apertures of said brush carrier for wetting said bristles.

2. A machine as defined in claim 1 wherein said brush carrier forms a bottom part of an annular liquid reservoir communicating with said conduit means.

3. A machine as defined in claim 2 wherein said reservoir has a closed top, further comprising a tube connected to a supply of compressed air and to said reservoir for placing the liquid therein under air pressure driving same through said apertures.

4. A machine as defined in claim 3 wherein said tube is provided with a control valve for regulating said air pressure.

5. A machine as defined in claim 3 wherein said drive means comprises an air motor connected to said supply by a hose, said tube being a branch of said hose.

6. A machine as defined in claim 2 wherein said reservoir is secured to said sanding wheel for joint oscillatory motion about said axis.

* * * * *